United States Patent [19]

Wagner

[11] Patent Number: 4,755,156

[45] Date of Patent: Jul. 5, 1988

[54] MARINE PROPULSION DEVICE WITH MECHANICAL LINKAGE FOR THROTTLE AND SHIFT CONTROLS

[75] Inventor: Jeffrey F. Wagner, Gurnee, Ill.

[73] Assignee: Outboard Marine Corporation, Waukegan, Ill.

[21] Appl. No.: 21,173

[22] Filed: Mar. 3, 1987

[51] Int. Cl.[4] ..... B63H 23/00

[52] U.S. Cl. ..... 440/75; 440/86; 440/87; 440/900

[58] Field of Search ..... 440/1, 84, 75, 86, 87; 74/480 B, 479, 878; 180/285, 282; 192/0.096

[56] References Cited

U.S. PATENT DOCUMENTS

| | | | |
|---|---|---|---|
| 2,208,364 | 7/1940 | Fusella | 123/179 |
| 2,407,877 | 9/1946 | Good | 74/483 |
| 2,785,584 | 3/1957 | Hambleton | 440/87 |
| 2,971,618 | 2/1961 | Morse | 192/0.096 |
| 2,973,069 | 2/1961 | Morse | 192/0.096 |
| 2,988,929 | 6/1961 | Williams | 74/878 |
| 3,131,795 | 5/1964 | Shimanckas | 192/0.096 |
| 3,183,879 | 5/1965 | Heidner | 115/18 |
| 3,285,361 | 11/1966 | Baker | 180/82 |
| 4,064,823 | 12/1977 | Draxler | 115/17 |

*Primary Examiner*—Joseph F. Peters, Jr.
*Assistant Examiner*—Edwin L. Swinehart
*Attorney, Agent, or Firm*—Michael, Best & Friedrich

[57] ABSTRACT

Disclosed herein is a marine propulsion device comprising an engine with a throttle operable to control fuel flow to the engine, a lower unit with a rotatably mounted propeller, a transmission for connecting the engine into driving engagement with the propeller, a throttle control lever connected to the engine throttle and adapted for operator movement of the throttle control lever between a minimum throttle position and a full open throttle position, a stop connected to the throttle control lever, a gear shift lever connected to the transmission and adapted for operator movement about a pivot axis between an engaged position and a neutral position, and including a first projection, a throttle blocking lever including first and second arms which rotate about the gear shift lever pivot axis, the first arm having an end positioned adjacent the throttle control lever stop, the second arm normally extending generally parallel to the gear shift lever, and including a second projection adjacent the first projection, and a spring for connecting the throttle blocking lever to the gear shift lever so that the end of the first arm of the throttle blocking lever bears against the throttle lever stop to prevent movement of the throttle control lever from the minimum throttle position to the full open throttle position when the gear shift lever is located in the neutral position. Movement of the throttle control lever from the minimum throttle position to the full open throttle position is allowed when the gear shift lever is not located in the neutral position.

11 Claims, 1 Drawing Sheet

MARINE PROPULSION DEVICE WITH MECHANICAL LINKAGE FOR THROTTLE AND SHIFT CONTROLS

BACKGROUND OF THE INVENTION

The invention relates to marine propulsion devices and more particularly, to such devices including mechanical linkages for coordinating throttle and shift control. Attention is directed to the following U.S. Pat. Nos.

Fusella, 2,208,364, July 16, 1940
Good, 2,407,877, Sept. 17, 1946
Morse, 2,971,618, Feb. 14, 1961
Morse, 2,973,069, Feb. 28, 1961
Shimanckas, 3,131,795, May 5, 1964
Heidner, 3,183,879, May 18, 1965
Baker, 3,285,361, Nov. 15, 1966
Draxler, 4,064,823, Dec. 27, 1977

SUMMARY OF THE INVENTION

The invention provides a marine propulsion device comprising an engine with a throttle operable to control fuel flow to the engine, a lower unit with a rotatably mounted propeller, a transmission for connecting the engine into driving engagement with the propeller, a throttle control lever connected to the engine throttle and adapted for operator controlled movement between a minimum throttle position and a full open throttle position, a gear shift lever connected to the transmission and adapted for operator controlled movement between an engaged position and a neutral position, a throttle blocking lever, and means for connecting the throttle blocking lever to the gear shift lever so that the throttle blocking lever prevents movement of the throttle control lever from the minimum throttle position to the full open throttle position when the gear shift lever is located in the neutral position.

In one embodiment, the connecting means connects the blocking lever for coincident rotation with the gear shift lever about a pivot axis and the blocking lever is moved out of the blocking position when the gear shift lever is pivoted to the engaged position, thereby allowing movement of the throttle lever from the minimum throttle lever position to the full open throttle position when the gear shift lever is not located in the neutral position.

In one embodiment, the throttle lever includes a stop located adjacent and an adjustable predetermined distance from the blocking lever when the gear shift lever is in the neutral position, the stop allowing the throttle control lever to be moved from the minimum throttle position to a predetermined intermediate throttle position before the blocking lever engages said stop to block movement of the throttle lever stop and to thereby prevent further speed advancing movement of the throttle lever.

In one embodiment, the connector means comprises spring means for exerting force which yieldably prevents relative motion of the blocking lever and the gear shift lever, but which can be overcome to allow relative movement of the gear shift lever and the blocking lever so that the gear shift lever can be pivoted to the neutral position independantly of the throttle control lever position. Preferably, the blocking lever includes first and second arms which rotate about the gear shift lever pivot axis, the first arm having an end positioned against the throttle lever stop when movement of the throttle lever is blocked, the second arm having a first projection, and the gear shift lever normally extends generally parallel to the second arm of the blocking lever and includes a second projection, and the spring means includes a spring which has a pair of legs biased toward each other and which respectively engage opposite sides of the projections to yieldably prevent relative motion of the gear shift lever and the blocking lever until the spring force is exceeded, at which point the spring legs are moved apart allowing relative movement of the gear shift lever and the blocking lever.

The invention also provides a marine propulsion device comprising a throttle operable to control fuel flow to the engine, a lower unit with a rotatably mounted propeller, a transmission for connecting the engine into driving engagement with the propeller, a throttle control lever connected to the engine throttle and adapted for operator movement of the throttle control lever between a minimum throttle position and a full open throttle position, a stop connected to the control throttle lever, a gear shift lever connected to the tranmission and adapted for operator controlled movement about a pivot axis between an engaged position and a neutral position, and including a first projection, a throttle blocking lever including first and second arms which rotate about the gear shift lever pivot axis, the first arm having an end positioned adjacent the throttle lever stop, the second arm normally extending generally parallel to the gear shift lever, and including a second projection adjacent the first projection, and spring means for connecting the throttle blocking lever to the gear shift lever so that the end of the first arm of the throttle blocking lever bears against the throttle lever stop to prevent movement of the throttle control lever from the minimum throttle position to the full open throttle position when the gear shift lever is located in the neutral position, and so that movement of the throttle lever from the minimum throttle position to the full open throttle position is allowed when the gear shift lever is not located in the neutral position, the spring means having a pair of legs biased toward each other and which grip both sides of the projections to prevent relative motion of the gear shift lever and the blocking lever until the spring means force is exceeded, at which point the spring means legs are moved apart allowing relative movement of the gear shift lever and the blocking lever.

The invention also provides a marine propulsion device comprising an engine with a throttle operable to control fuel flow to the engine, a lower unit with a rotatably mounted propeller, a transmission for connecting the engine into driving engagement with the propeller, a throttle control lever connected to the engine throttle and adapted for operator movement of the throttle control lever relative to a full open throttle position, a gear shift lever connected to the transmission and adapted for operator controlled movement between an engaged position and a neutral position, and blocking means connected to the gear shift lever and selectively operable for preventing movement of the throttle control lever to the full open position when the shift lever is located in the neutral position.

In one embodiment, the blocking means is operable for allowing movement of the throttle lever to the full open throttle position when the gear shift lever is not located in the neutral position, and so that the gear shift lever can be pivoted to the neutral position independantly of the throttle lever position.

One of the principal features of the invention is the provision of a marine propulsion device including an engine with a throttle operable to control fuel flow to the engine, a lower unit with a rotatably mounted propeller, a transmission for connecting the engine into driving engagement with the propeller, a throttle control lever connected to the engine throttle and adapted for operator movement of the throttle control lever between a minimum throttle position and a full open throttle position, a gear shift lever connected to the transmission and adapted for operator movement between an engaged position and a neutral position, a throttle blocking lever, and means for connecting the throttle blocking lever to the gear shift lever so that the throttle blocking lever prevents movement of the throttle control lever from the minimum position to the full open throttle position, and thus prevents over speeding of the engine, when the gear shift lever is located in the neutral position.

Another of the principal features of the invention is the provision of such a marine propulsion device wherein the blocking lever rotates with the gear shift lever about a pivot axis and the blocking lever is moved out of the blocking position when the gear shift lever is pivoted to the engaged position, thereby allowing movement of the throttle control lever from the minimum throttle position to the full open throttle position when the gear shift lever is not located in the neutral position.

Another of the principal features of the invention is the provision of such a marine propulsion device wherein the throttle control lever includes a stop located adjacent and a predetermined distance from the blocking lever when the gear shift lever is in the neutral position, the stop allowing the throttle control lever to be moved from the minimum throttle position to a predetermined intermediate throttle position before the blocking lever blocks movement of the throttle control lever stop and prevents further speed advancing movement of the throttle control lever.

Another of the principal features of the invention is the provision of such a marine propulsion device wherein the connector means comprises spring means for exerting force which yieldably prevents relative motion of the blocking lever and the gear shift lever, but which can be overcome to allow relative movement of the gear shift lever and the blocking lever so that the gear shift lever can be pivoted to the neutral position independently of the throttle control lever position.

Other features and advantages of the embodiments of the invention will become known by reference to the following general description, the appended claims and drawings.

DRAWINGS

Figure 2:
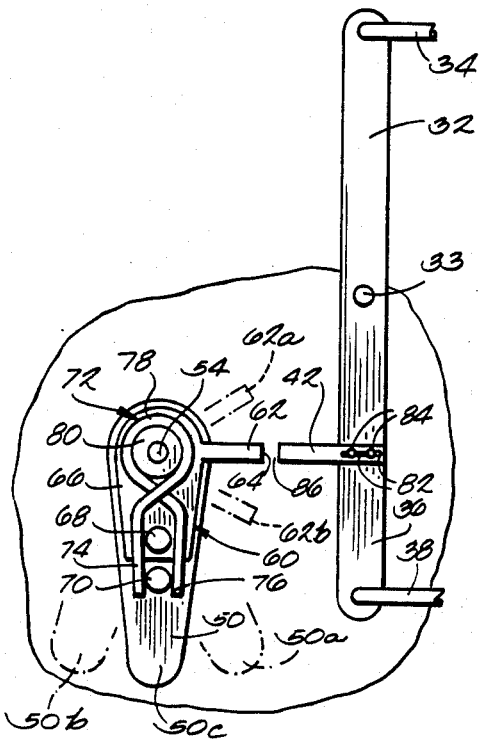
FIG. 2 is an enlarged view of a portion of the marine propulsion device shown in FIG. 1.
Figure 1:
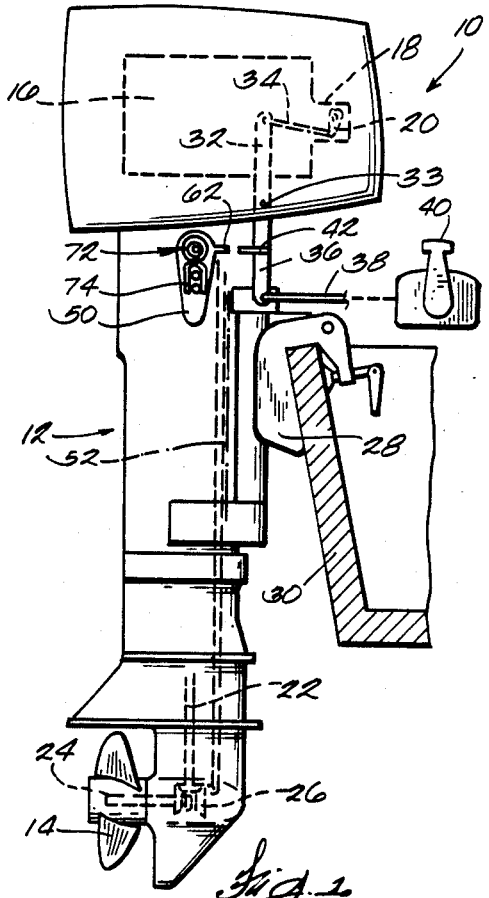
FIG. 1 is a diagrammatic side elevational view of a marine propulsion device embodying various of the features of the invention.

Before explaining the embodiments of the invention in detail, it is to be understood that the invention is not limited in its application to the details of the construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device in the form of an outboard motor 10 including a lower unit 12 with a rotatably mounted propeller 14. The outboard motor 10 conventionally includes an engine 16 and a carburetor 18 (both diagramatically shown) having a throttle 20 operable to control fuel flow to the engine 16. The lower unit 12 houses a drive shaft 22 (partially shown) innerconnected with a propeller shaft 24 by a transmission 26 to drive the propeller 14. The marine propulsion device conventionally includes a transom bracket 28 which is adapted for mounting to a boat transom 30.

The marine propulsion device includes a throttle control lever 32 pivotably mounted adjacent engine 16 on a suitably supported pivot point 33 and connected to the engine throttle 20 by a suitable linkage 34. Throttle control lever 32 is adapted for operator movement between a minimum throttle position (shown in FIG. 2) and a full open throttle position. While various arrangements are possible, in the preferred embodiment the lower end 36 of the throttle control lever 32 is connected to an operator control 40 (diagramatically shown) by a push pull cable 38. Also, in the preferred embodiment, the throttle control lever 32 includes a stop 42, discussed in more detail below.

The marine propulsion device 10 also includes a gear shift lever 50 suitably connected to the transmission 26 by a linkage 52 (diagramatically shown) and adapted for operator movement about a suitably supported pivot pin or pivot axis 54 between an engaged and neutral position. More particularly, as shown in FIG. 2, when the gear shift lever is moved to position **50*a* the transmission is shifted to an engaged forward position so that the propeller is rotated in a forward direction, and when the gear shift lever 50 is moved to position 50*b*, the transmission is shifted to an engaged reverse position so that the propeller rotates in reverse. The neutral position of gear shift lever 50, when the transmission is in neutral and not engaged, is labeled 50*c***.

Figure 3:
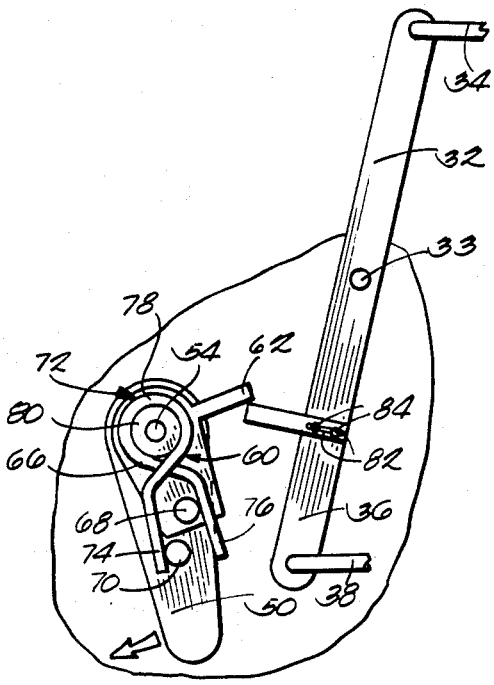
FIG. 3 is a view similar to FIG. 2 illustrating a different condition of operation of the marine propulsion device shown in FIG. 1.
Figure 4:
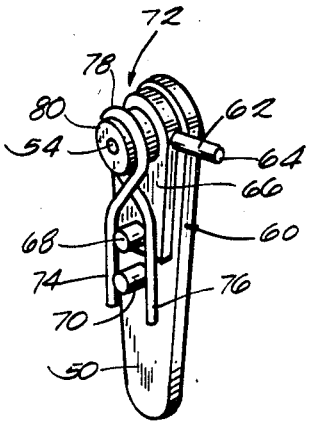
FIG. 4 is a partial perspective view of the gear shift lever and throttle blocking lever included in the marine propulsion device shown in FIG. 1.

As best illustrated in FIGS. 2, 3 and 4, the marine propulsion device also includes a throttle blocking lever 60 and means for connecting the throttle blocking lever to the gear shift lever 50 so that blocking lever 60 prevents movement of the throttle control lever 32 to a full open throttle position when the gear shift lever 50 is located in the neutral position **50*c***, thus preventing overspeeding of the engine when the transmission is in neutral.

More particularly, in the preferred embodiment illustrated, the throttle blocking lever 60 includes a first arm 62 having an end 64 positioned adjacent the throttle lever stop 42, and a body or second arm 66 normally extending generally parallel to the gear shift lever 50 and suitably mounted for rotation about the pivot pin or pivot axis 54. The second arm 66 of the throttle blocking lever 60 includes a suitably secured projection or peg 68 which is located adjacent a projection or peg 70 suitably secured to the gear shift lever 50.

Connecting means, preferably in the form of spring means, is provided for exerting force which yieldably prevents relative motion of the blocking lever and the gear shift lever. In the preferred embodiment, the force of the spring means can be overcome to allow relative movement of the gear shift lever 50 and the blocking lever 60 so that the gear shift lever can be pivoted to the neutral position independantly of the throttle control lever position.

More particularly, while various arrangements are possible, in the preferred embodiment such spring means comprises a spring generally designated 72 and having a loop portion 78 connected to a pair of legs 74 and 76 which are biased toward each other and which respectively engage the opposite sides of the projections 68 and 70 as shown in FIG. 2 to prevent relative motion of the gear shift lever and the blocking lever. The spring loop portion 78 engages an annular projection or boss 80 on the blocking lever 60, and the boss 80 is journalled on the pin or pivot axis 54 so that the spring 72 normally pivots about pivot axis 54 with the blocking lever 60 and gear shift lever 50. The loop portion 78 of the spring can be held in place on boss 80 by any suitable means, and in the preferred embodiment, the loop portion 78 engages a circular groove (not shown) on boss 80. When the spring force is exceeded, such as when the operator moves the gear shift lever 50 toward neutral while the throttle control lever 32 is displaced from the minimum position, as shown in FIG. 3, the spring legs 74 and 76 are moved apart allowing relative movement of the gear shift lever and the blocking lever, as illustrated in FIG. 3.

In order to control the extent of movement of the throttle control lever from the minimum throttle position to an intermediate throttle position and to prevent further throttle advancing movement of the throttle control lever is prevented.

In the preferred embodiment, means are provided for adjustably connecting or securing the throttle lever stop 42 to the throttle lever 32 so that the throttle lever stop 42 can be spaced a predetermined adjustable distance from the end 64 of the first arm of the blocking lever 60. While various arrangements are possible, in the preferred embodiment, the adjustable connection means comprises provisions on the throttle lever stop 42 of a pair of slots 82 and a pair of machine screws 84 which extend through the slots. A predetermined adjustable distance, designated by numeral 86 in FIG. 2, may be varied to suit the degree of throttle control lever travel limitation desired, by changing the position of the slotted stop 42 relative to screws 84, prior to tightening the screws and fixing the stop 42 to the throttle lever 32.

If the gear shift lever 50 is pivoted to the forward position 50*a* or the reverse position 50*b*, the blocking lever 62 is pivoted to position 62*a* or 62*b*, respectively, as illustrated in FIG. 2. Thus, when the gear shift lever 50 is shifted to an engaged position, the blocking lever 62 is pivoted out of alignment with the throttle control lever stop 42, allowing the throttle control lever 32 to move toward the open throttle position without restriction.

If the gear shift lever 50 is moved toward the neutral position 50*c* while the throttle is open beyond the limited travel position, the blocking lever arm 62 will contact the throttle lever stop 42, causing the pegs 68 and 70 to seperate laterally, thus spreading the legs 74 and 76 of the spring 72 as the shift lever 50 continues to rotate into the neutral position. This allows an operator to shift to neutral without closing the throttle fully, as in an emergency condition or during special manuevering operations. When the throttle control lever 32 is moved to the minimum throttle position, the spring 72 returns the pegs 68 and 70 into alignment, bringing the blocking lever arm 62 back into alignment with the throttle lever stop 42, so that movement of the throttle control lever from a minimum to a full open throttle position and overspeeding of the engine is prevented when the transmission is in neutral.

Various other features of the invention are set forth in the following claims.

What is claimed is:

1. A marine propulsion device comprising a propulsion unit including an engine with a throttle operable to control fuel flow to said engine, and a lower unit including a rotatably mounted propeller, and a transmission for connecting said engine in driving engagement with said propeller, a throttle control lever movably connected on said propulsion unit and connected to said engine throttle and adapted for operator controlled movement between a minimum throttle position and a full open throttle position, a gear shift lever movably mounted on said propulsion unit and connected to said transmission and adapted for operator controlled movement between an engaged position and a neutral position, a blocking member movably mounted on said propulsion unit for movement relative to a throttle blocking position preventing movement of said throttle control lever from said minimum throttle position to said full open throttle position, and means for connecting said blocking member to said gear shift lever so that movement of said gear shift lever to said neutral position locates said blocking member in said throttle blocking position.

2. A marine propulsion device in accordance with claim 1 wherein said connecting means connects said blocking member with said gear shift lever for coincident and relative rotation with said gear shift lever about a pivot axis, and wherein said blocking member is moved out of said blocking position when said gear shift lever is pivoted to said engaged position, thereby allowing movement of said throttle lever from said minimum throttle lever position to said full open throttle position when said gear shift lever is not located in said neutral position.

3. A marine propulsion device in accordance with claim 2 wherein said throttle lever includes a stop located adjacent and a predetermined distance from said blocking member when said gear shift lever is in said neutral position, said stop allowing said throttle control lever to be moved from said minimum throttle position to a predetermined intermediate throttle position before said blocking member engages said stop to block movement of said throttle lever stop and to thereby prevent further speed advancing movement of said throttle control lever.

4. A marine propulsion device in accordance with claim 3 wherein said blocking member comprises a lever and wherein said connector means comprises spring means for exerting force which yieldably prevents relative motion of said blocking member and said gear shift lever, but which can be overcome to allow relative movement of said gear shift lever and said blocking member so that said gear shift lever can be pivoted to said neutral position independently of the throttle control lever position.

5. A marine propulsion device in accordance with claim 4 wherein said blocking member includes first and second arms which rotate about said gear shift lever pivot axis, said first arm having an end positioned against said throttle lever stop when movement of said throttle lever is blocked, said second arm having a first projection, and wherein said gear shift lever normally extends generally parallel to said second arm of said blocking member and includes a second projection, and wherein said spring means includes a spring which has a pair of legs biased toward each other and which respectively engage opposite sides of said projections to yieldably prevent relative motion of said gear shift member and said blocking lever until the spring force is exceeded, at which point said spring legs are moved apart allowing relative movement of said gear shift lever and said blocking member.

6. A marine propulsion device in accordance with claim 5 and wherein said first arm of said blocking member is generally perpendicular to said second arm of said blocking member.

7. A marine propulsion device in accordance with claim 6 and further comprising an adjustable connection means for adjustably securing said throttle lever stop to said throttle control lever so that said throttle lever stop can be spaced a predetermined adjustable distance from said end of said first arm of said blocking member to allow control of the extent of movement of said throttle control lever from said minimum throttle position before further speed advancing movement of said throttle control lever is prevented.

8. A marine propulsion device comprising an engine with a throttle operable to control fuel flow to said engine, a lower unit with a rotatably mounted propeller, a transmission for connecting said engine in driving engagement with said propeller, a throttle control lever connected to said engine throttle and adapted for operator movement of said throttle control lever between a minimum throttle position and a full open throttle position, a stop connected to said throttle control lever, a gear shift lever connected to said transmission and adapted for operator movement about a pivot axis between an engaged position and a neutral position, and including a first projection, a throttle blocking lever including first and second arms which rotate about said gear shift lever pivot axis, said first arm having an end positioned adjacent said throttle lever stop, said second arm normally extending generally parallel to said gear shift lever, and including a second projection adjacent said first projection, and spring means for connecting said throttle blocking lever to said gear shift lever so that said end of said first arm of said throttle blocking lever bears against said throttle lever stop to prevent movement of said throttle lever from said minimum throttle position to said full open throttle position when said gear shift lever is located in said neutral position, and so that movement of said throttle control lever from said minimum throttle position to said full open throttle position is allowed when said gear shift lever is not located in said neutral position, said spring means having a pair of legs which are biased toward each other and which respectively engage opposite sides of said projections to prevent relative motion of said gear shift lever and said blocking lever until the spring means force is exceeded, at which point said spring means legs are moved apart allowing relative movement of said gear shift lever.

9. A marine propulsion device in accordance with claim 8 wherein said first arm of said blocking lever is generally perpendicular to said second arm of said blocking lever, and further comprising an adjustable connection means for adjustably securing said throttle lever stop to said throttle control lever so that said throttle control lever stop can be spaced a predetermined adjustable distance from said end of said first arm of said blocking lever to allow control of the extent of movement of said throttle control lever from said minimum throttle position before further speed advancing movement of said throttle control lever is prevented.

10. A marine propulsion device comprising a propulsion unit including an engine with a throttle operable to control fuel flow to said engine, and a lower unit with a rotatably mounted propeller, and a transmission for connecting said engine in driving engagement with said propeller, a throttle control lever movably mounted on said propulsion unit and connected to said engine throttle and adapted for operator controlled movement of said throttle control lever relative to a full open throttle position, a a gear shift lever movably mounted on said propulsion unit and connected to said transmission and adapted for operator controlled movement between an engaged position and a neutral position, and blocking means including a member movably mounted on said propulsion unit and connected to said gear shift lever and selectively operable for preventing movement of said throttle control lever to said full open position when said gear shift lever is located in said neutral position.

11. A marine propulsion device in accordance with claim 10 wherein said blocking means is operable for allowing movement of said throttle control lever to said full open throttle position when said gear shift lever is not located in said neutral position, and so that said gear shift lever can be pivoted to said neutral position independently of the throttle control lever position.

* * * * *